United States Patent [19]

Munk

[11] 4,047,570

[45] Sept. 13, 1977

[54] SPRINKLER SYSTEM FOR EXISTING BUILDINGS

[76] Inventor: Michael E. Munk, 28 Dorchester Drive, Port Chester, N.Y. 10573

[21] Appl. No.: 664,587

[22] Filed: Mar. 8, 1976

[51] Int. Cl.[2] ..... A62C 35/00

[52] U.S. Cl. ..... 169/16; 98/40 B

[58] Field of Search ..... 169/16, 17, 43, 46; 98/40 B, 40 D; 165/53

[56] References Cited

U.S. PATENT DOCUMENTS

| | | | |
|---|---|---|---|
| 2,265,810 | 12/1941 | Lowe et al. | 169/16 |
| 2,558,175 | 6/1951 | Gieseler | 169/19 X |
| 2,718,383 | 9/1955 | Frenger | 98/40 D X |
| 2,848,935 | 8/1958 | Demuth | 98/40 B |
| 3,177,795 | 4/1965 | Schutt | 98/40 B |
| 3,584,689 | 6/1971 | Willms | 169/17 |

*Primary Examiner*—Evon C. Blunk
*Assistant Examiner*—Michael Mar
*Attorney, Agent, or Firm*—Charles E. Baxley

[57] ABSTRACT

A sprinkler system is furnished for an existing building by placing in the air ducts above the hung ceilings main branch tubes made of plastic. The main branch tubes mounted in the air ducts are in fluid communication with sprinkler heads by connecting secondary branch tubes. Additional branch tubes are provided which connect the main branch tubes with the supply of water and which also allow for the avoidance of obstructions within any duct by rerouting the main branch tubes outside of the ducts until the obstruction is cleared. The invention receives the supply of water from an existing standpipe of a building, and is supplied with control means for regulating the flow of water.

7 Claims, 6 Drawing Figures

SPRINKLER SYSTEM FOR EXISTING BUILDINGS

BACKGROUND OF THE INVENTION

The present invention is directed to a sprinkler system for office buildings, residential buildings, and other structures where fire could cause loss of life and property.

Sprinkler systems in modern structures are well known. Typically, the prior art sprinkler systems have been designed to be installed during the erection of the structure, or to be installed when the threat of fire is realized thereby necessitating the complete renovation of the structure.

When sprinkler systems are installed after the erection of the building to conform to fire prevention of the building, the existing fixtures of the building must be redesigned in order to accommodate the new sprinkler system. This redesigning entails such a complete renovation that occupancy of the building and the productive work done in the building are prevented until the renovation is completed. The renovation may take many days to complete, thereby causing inconvenience and the additional burden of increased cost, which must be accounted for in the determination of the overall cost of installing the sprinkler system.

Present methods of installing sprinkler systems require the complete redesign of the cavities above the ceiling of the building, such cavities containing a maze of ducts, piping and wiring. Therefore, when present methods of installing a sprinkler system are employed, the design of the sprinkler system itself and the installation thereof must take into account the redesign of the ducts, pipes, wiring, etc. in the cavity which leads to a multifold increase in cost.

SUMMARY OF THE INVENTION

It is, therefore, the primary object of the present invention to provide an inexpensive and easily installable sprinkler system that may be used in all existing buildings having hung ceilings and air ducts positioned above the ceilings.

The present invention is directed to both the method of installing a sprinkler system and to the structure of the sprinkler system itself. To this end, the sprinkler system of the present invention contemplates a plurality of main branch tubes made of plastic which are mounted within the ducts positioned above the hung ceilings of the building. Secondary branch tubes lead from the main branch tubes to sprinkler heads mounted in conventional grilles or diffusers contained in the ceilings. Tertiary branch tubes provide for the avoidance of obstructions in the ducts by connecting two separate and spaced portions of the main branch tubes together. The tertiary tubes extend from a portion of the outerwalls of the ducts to another portion of the outerwalls of the ducts to thereby avoid the obstructions.

The main branch tubes, which run along the presently existing air duct system of the building, are in fluid communication with a water supply through other tertiary branch tubes. The water supply is provided by the existing standpipe of the building in which the sprinkler system of the present invention is being installed.

BRIEF DESCRIPTION OF DRAWINGS

The invention will be more readily understood with reference to the following detailed description when read in conjunction with the accompanying drawings wherein.

DETAILED DESCRIPTION OF THE INVENTION

The sprinkler system of the present invention utilizes the heating and cooling ducts located above the ceiling in a building. The main branch pipes of the sprinkler system are installed in these ducts thereby affording easy installation and the maximum utilization of cavity space above the ceiling. Such a design does not entail the redesigning of the maze of pipes, ducts and wiring located in the cavities which has been the major drawback of prior art systems.

The sprinkler system of the present invention has a number of main branch tubes which are mounted within the ducts of the building located in the cavity above the ceiling. These main branch tubes are made of plastic such as polyethelene. Branching off from the main branch tubes are secondary branch tubes which connect the main branch tubes with sprinkler heads of conventional design. The secondary branch tubes extend through the diffusers and grilles in the ceilings of the building, such diffusers and grilles being removably mounted in the ceilings and arranged in a regular modular pattern. These secondary branch tubes are typically made of copper, brass or other metal or alloy thereof. Also branching off from the main branch tubes are tertiary branch tubes which are also made of copper, brass, and the like and extend out from the duct in those portions of the duct that are closed off by heating coils, turning vanes, dampers and the like. These tertiary branch tubes exit from the duct just before the obstruction therein and reenter the duct just after the obstruction.

Figure 1:
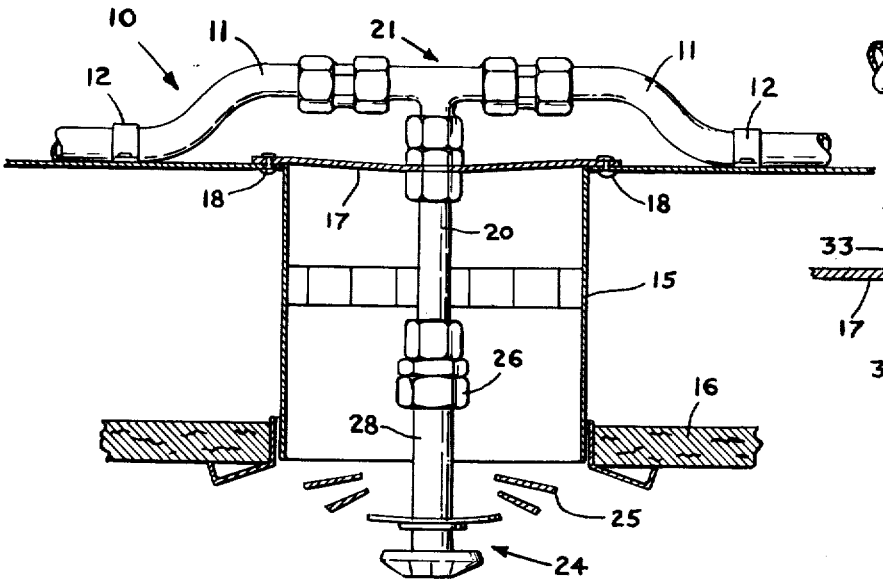
FIG. 1 is a schematic showing of a portion of the sprinkler system of the present invention installed in a duct of the building.

In FIG. 1 there is shown a portion of a heating, cooling or ventilating duct 10 which runs above the ceiling of a room in the cavity which contains, in addition to the ducts, electrical wiring and pipes. Mounted within this portion of the duct 10 is a portion of one main branch tube 11 which is fastened to the wall of the duct by clamps 12 riveted thereto. The portion of the main branch tube 11 shown is situated above conventional diffuser grid 15 extending from the wall of the duct to a flush position with the ceiling tile 16 of a room. The diffuser grid 15 may be mounted to the wall of the duct in any conventional manner and is shown mounted thereto by a support strap 17 fastened to the wall of the duct by pop rivets 18. The diffuser grid 15 is situated between openings in both the wall of the grid and a number of ceiling tiles.

Branching off from the main branch tube 11 is a secondary branch tube 20 connected to the main branch tube by provision of suitable hole formed in the main branch tube, thereby forming a "Compression Tee" 21. The secondary branch tube 20 passes along the support strap 17 and through suitable openings formed in the diffuser grid 15, and is connected to a conventional sprinkler head 24 extending from the diffuser 25 of the diffuser grid and which is mounted thereto in any conventional manner.

The secondary branch tube 20 may be connected to the sprinkler head 24 by any conventional interconnecting means 26 which connects the tube 20 with a pipe 28 of the sprinkler head. The secondary branch tube 20 is made of copper, brass, or the like and is typically three-fourths inches in diameter, while the main branch tube 21 is typically one inch or three-fourths inches in diameter. The pipe 28 is usually one-half inches in diameter. While only one connection of a main branch tube 11 with a sprinkler head has been shown, it is to be understood that similar structure exists for the other portions of the main branch tubes that are connected with sprinkler heads which main branch tubes extend along other ducts in the building. Although in FIG. 1 there has been shown a connection with a sprinkler head 24 via a diffuser grid 15, it is to be understood that the connection may be achieved via a grille or lighting fixture diffuser with the only difference being that the support of the secondary branch tube 20 and the conventional sprinkler head 24 will be accomplished by means associated with the particular elements through which the tube 20 and sprinkler head 24 pass.

Figure 2:
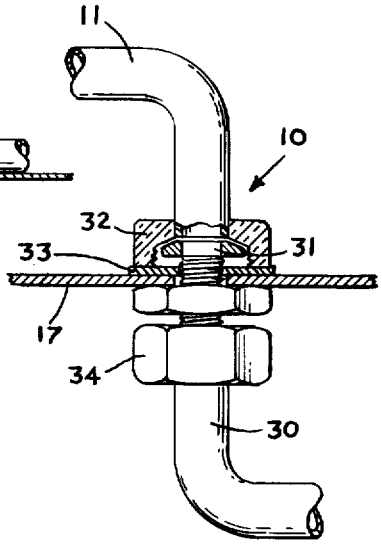
FIG. 2 is a schematic showing of the duct entry and the mounting thereof of a main branch of the sprinkler system of the present invention.

FIG. 2 shows the typical duct entry of the main branch tube whether it be for initial entry and exit or for the avoidance of an obstacle in the duct itself. The main branch tube 11 is connected to a tertiary branch tube 30 made of copper or the like and has compression ring 31, ferrule nut 32 and gasket 33 mounted on the threaded end thereof. The tertiary branch tube 30 is connected to the end of the main branch tube 11 by a conventional tube union connection 34. The tertiary branch tube 30 is typically a one inch diameter tube.

Figure 3:
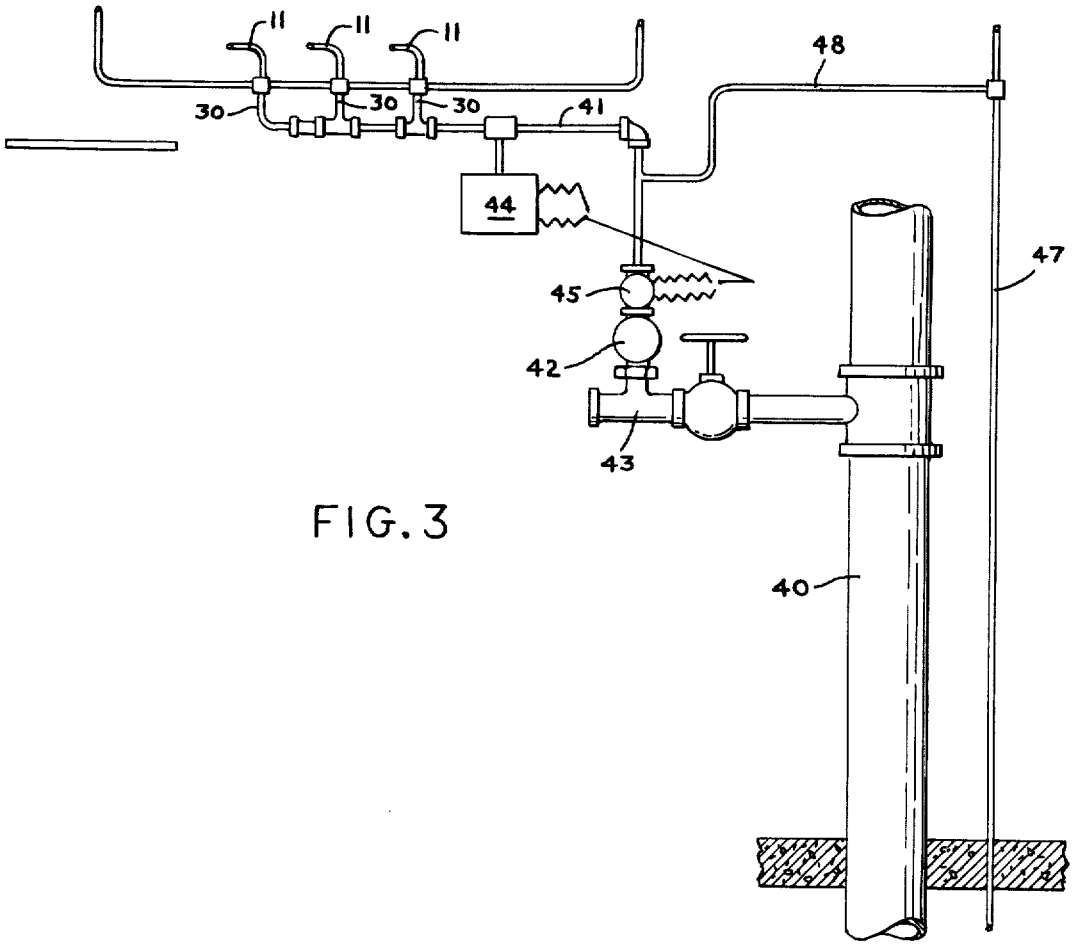
FIG. 3 is a schematic showing of the sprinkler system's water supply line of the present invention.

In FIG. 3 there is shown the sprinkler service take off device which supplies water to the main, secondary and tertiary branch tubes. A conventional standpipe 40 of the building is connected to three tertiary branch tubes 30 via a pipe 41. The three tertiary branch tubes 30 in turn are connected to three main branch tubes 11 which are directed along three different ducts for subsequent passage to different areas and ducts of the building. The tertiary tubes 30 are connected to the main branch tubes in the manner disclosed above with reference to FIG. 2. The pipe 41 is in fluid communication with the standpipe 40 via a pressure regulating valve 42 and interconnection 43. Provided along the pipe 41 are a pressure electric switch 44 and an alarm check 45, both of which are electrically connected to an alarm (not shown). The pressure electric switch 44 is a conventional device where a spring is balanced by air pressure holding electric contacts open so that if pressure fails the contacts close. A main air pilot line 47 extends parallel with the standpipe 40 and is connected to the pipe 41 via a line 48 between the pressure electric switch 44 and the alarm check 45. The main pilot line is used to seat the branch line check valve for keeping water out of the sprinkler branch line. In use, the pressure regulating valve 42 is set at about 75 P.S.I.G. while the main air pilot line 47 supplies air at 90 P.S.I.G. and the pressure electric switch 44 is set at 60 P.S.I.G.

In operation the branch line is sealed at the service end by the check valve and along its length by fusible sprinkler heads. When heat from a fire melts a sprinkler head the line pressure drops. Thus the water pressure forces the check valve and water flows via the line through the sprinkler head.

The sprinkler system of the present invention is easily installable in any structure having heating, cooling or ventilating ducts and is much less costly than any of the prior art systems. Access to the ducts above the ceiling are readily available through access doors provided therefor, and the installation of the system does not entail the renovation and redesign of the existing piping and electrical wiring system in place. The normal routine of the occupants of the building is only minimally effected by the installation of the system and may be completed in a very short time. Installation is capable of being achieved at a rate of six sprinkler heads per day. Further, since the main branch tubes of the present invention are positioned within ducts, the objection hitherto present to the use of a plastic tubing is obviated since the sheetmetal ducts act as a protection for the tubes. Therefore, accidental damage, support, temperature extremes which have prevented the use of plastic tubing are no longer deterrents to the use of plastic tubing. Two man installation crews, working with light hand tools, on ladders, can readily install the system using prefabricated fitting assemblies. One or two sprinkler heads per room may be provided depending upon the size and lay out of the room.

Figure 4:
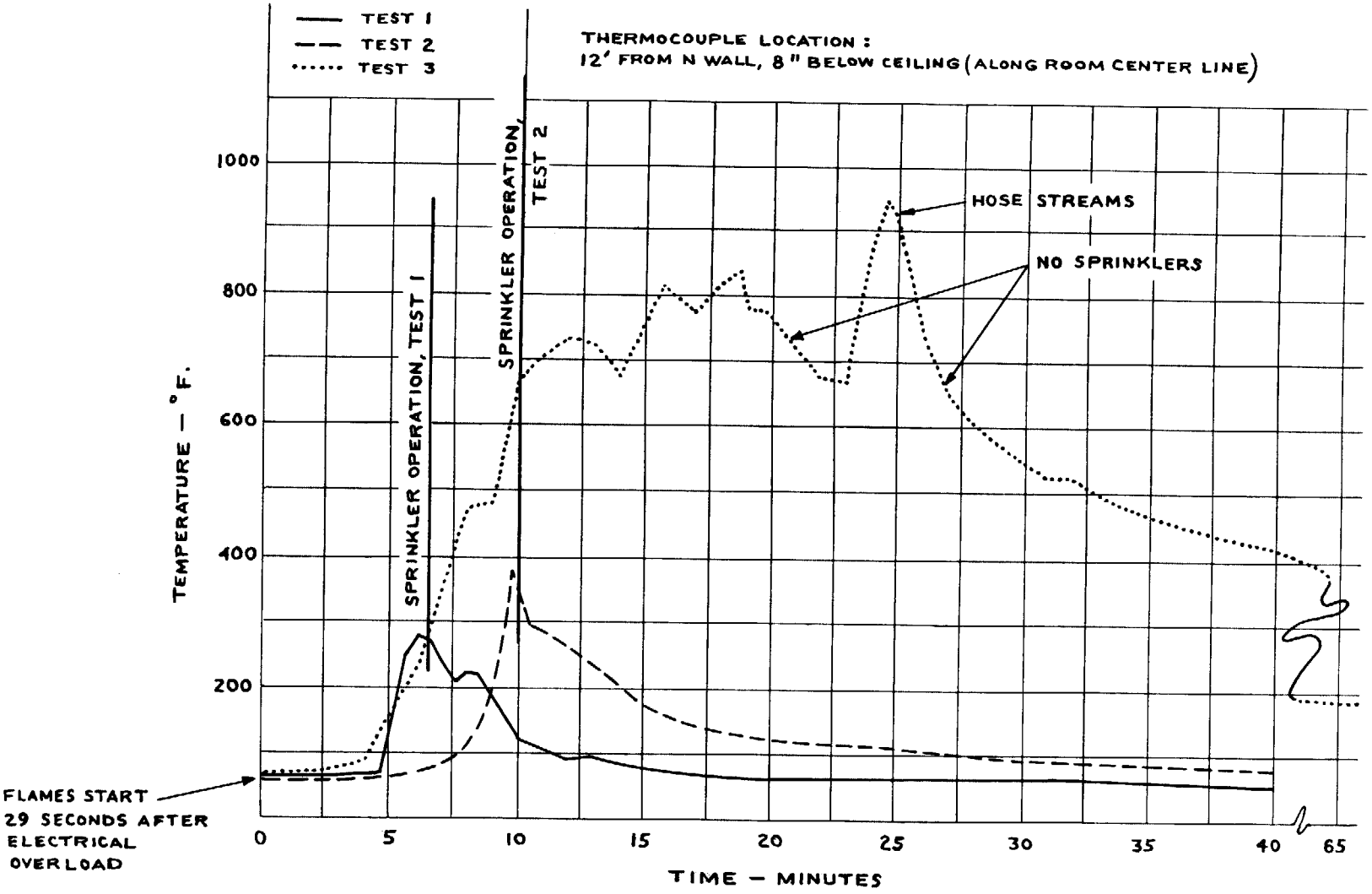
FIG. 4 is a graph showing the results of tests using the sprinkler system of the present invention.

FIG. 4 shows the result of three tests where a room was set on fire by faulty electrical wiring. In one test no sprinkler system was used, and in the other two tests the sprinkler system of the present invention was used. The thermocouple for detecting the temperature in the room, and therefore, for a fire, was placed 12 feet from the north wall of the room, 8 inches below the ceiling along the center line thereof. In Test 1, represented by the solid line, the sprinkler system of the present invention operated approximately 7 minutes after the onset of the fire and at a temperature of about 275° F. The fire was extinguished in about 10 minutes. In Test 2, the sprinkler system of the present invention operated at approximately 375° F. and about 10 minutes after the onset of the fire. The fire was extinguished about 30 minutes after operation. In Test 3, there was no sprinkler and the fire was fought by hose steam starting 25 minutes after the start of the fire.

Figure 5:
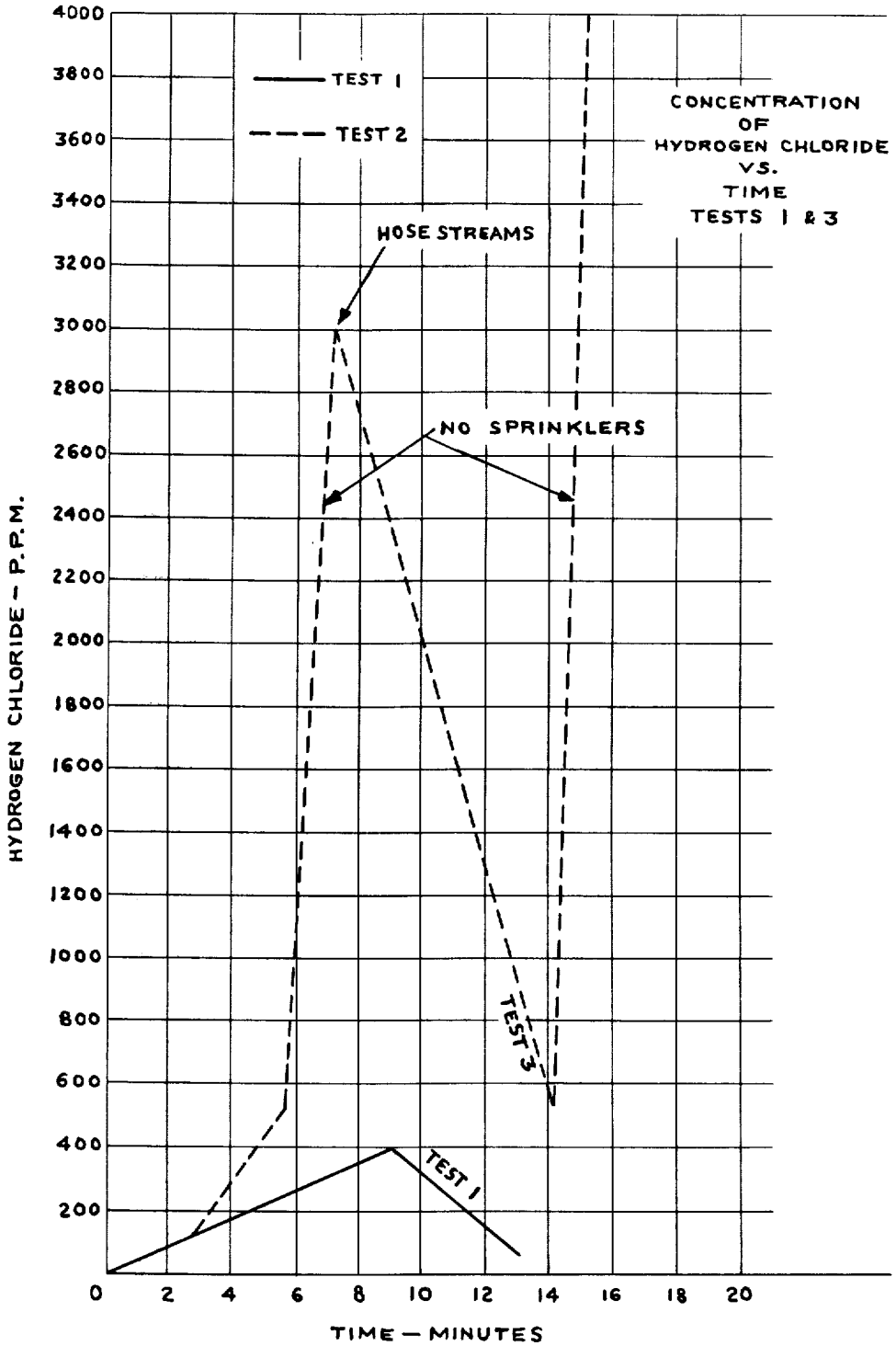
FIG. 5 is a graph showing the concentration of hydrogen chloride in the tests of the sprinkler system of the present invention.

FIG. 5 shown the results of the concentration of toxic hydrogen chloride for Test 1 where a sprinkler system was used and for Test 3 where no sprinkler system was used. As can be seen, the toxic gas was constrained to a very small percentage of what would have occurred if the sprinkler system of the present invention were not present.

Figure 6:
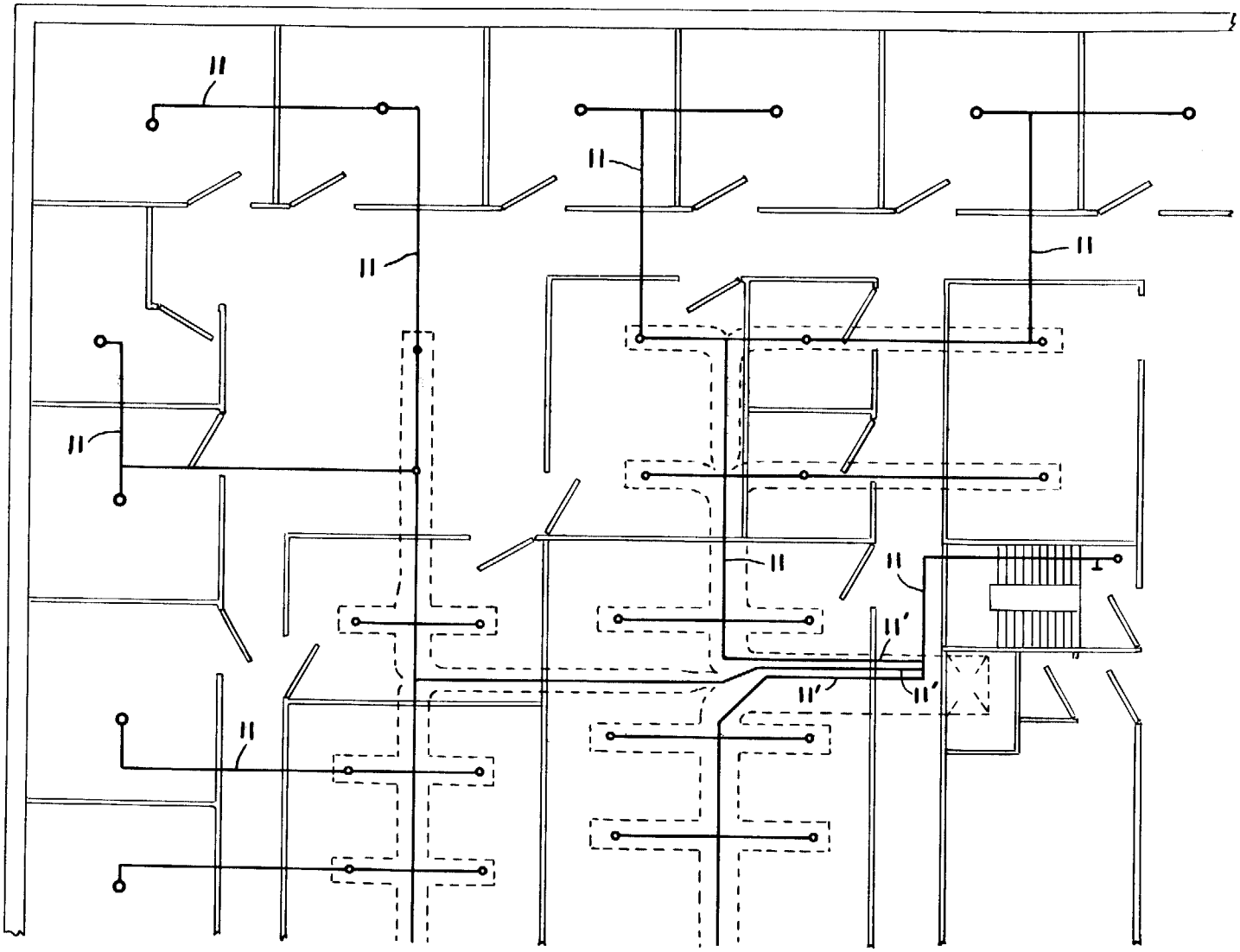
FIG. 6 is a schematic showing of the main branches, secondary branches and tertiary branches of the present invention for a plurality of rooms of a building.

The present invention not only provides a safe, effective and relatively inexpensive sprinkler system, but affords easy installation by connecting the large number of main branch tubes to the existing water standpipe of the building. As shown in FIG. 6, the sprinkler system of the present invention may be adapted to any number of rooms with the three main branch lines indicated by reference character 11' in fluid communication with the existing standpipe of a building through line 41.

There has thus been shown a novel manner of utilizing the duct work in existing buildings as a raceway and supporting system for the flexible piping system. The air distribution outlet diffusers are used for sprinkler head mounting and tube pulling handholes, causing trivial alterations to existing building systems, surfaces and occupants, thereby providing a markedly reduced cost. The utilization of the duct work as a tubing raceway, with its in place diffusers, providing both modular and individual fixed ceiling outlet positions, allows great ease and flexibility in the location and installation of sprinkler heads.

There will now be obvious to those skilled in the art many modifications and variations satisfying many or all of the objects, but not departing from the spirit of the invention as defined by the appended claims.

I claim:

1. In a sprinkler system for a building having at least one room and at least one hung ceiling for said one room, at least one duct for heating, ventilating or cooling mounted in the cavity above said at least one ceiling, at least one element mounted to the wall of said one hung ceiling which is in fluid communication with the interior of said one duct and the interior of said one room, wherein the improvement comprises: at least one main branch tube mounted within said one duct so that said one duct completely surrounds said one main branch tube; means for mounting said one main branch tube in said one duct; at least one secondary branch tube having a first end in fluid communication with the interior of said one main branch tube and a second end mounted in said one element in communication with the interior of said one duct; means for connecting said first end to said one main branch tube; one sprinkler head mounted in said one element and connected to and in fluid communication with said second end of said one secondary branch tube; means for supplying water to said one main branch tube and said one secondary branch tube; means for automatically controlling the operation of said one sprinkler head in response to a fire being detected in said one room; and one tertiary branch tube having a first end connected to and in fluid communication with said one main branch tube and a second end connected to and in fluid communication with said one means for supplying water and said one main branch tube; and means for connecting said first end of said one tertiary branch tube to said one main branch tube, whereby upon the start of a fire in a room, the sprinkler head is supplied with water under pressure via the main branch tube, the secondary branch tube and the tertiary branch tube.

2. The improvement according to claim 1, wherein said second end of said one tertiary branch tube is connected to a portion of said one main branch tube spaced longitudinally from the portion of said one main branch tube connected to said first end of said one tertiary branch tube, said means connecting at least said first end of said one tertiary branch tube also connecting said second end of said one tertiary branch tube to said one main branch tube.

3. The improvement according to claim 1, wherein said means for connecting said first end of said one tertiary branch tube comprises a nut mounted on said one main branch tube, a compression ring mounted within said nut, a gasket also mounted on said one main branch tube, and tube connecting means mounted on said one tertiary branch tube and said one main branch tube, said one main branch tube being threaded to receive said tube connecting means to said nut.

4. The improvement according to claim 1, wherein said main branch tube is made of plastic, and said at least one secondary branch tube is made of metal.

5. The improvement according to claim 1, wherein said means for connecting said first end of said one secondary branch tube to said one main branch tube comprises a compression tee.

6. The improvement according to claim 1, wherein said means for supplying water comprises a standpipe, hose connecting means connecting said standpipe with said one main branch tube, a pressure electric set connected to said one tertiary branch tube, a sprinkler pressure regulating valve positioned between said hose connecting means and said one tertiary branch tube, and an alarm check position between said sprinkler pressure regulating valve and said one tertiary branch tube.

7. The improvement according to Claim 1, wherein said, building comprises a number of rooms, and said sprinkler system comprises a plurality of main branch tubes, a plurality of secondary branch tubes, and a plurality of tertiary branch tubes, each of said rooms having a hung ceiling with at least one duct, and at least one main branch tube within said at least one duct, at least one secondary tube, and at least one sprinkler head.

* * * * *